US009033853B1

(12) United States Patent
McMurtrey

(10) Patent No.: US 9,033,853 B1
(45) Date of Patent: May 19, 2015

(54) JUNGLE JUMPAROO SYSTEMS

(71) Applicant: Stephen McMurtrey, Orlando, FL (US)

(72) Inventor: Stephen McMurtrey, Orlando, FL (US)

( * ) Notice: Subject to any disclaimer, the term of this patent is extended or adjusted under 35 U.S.C. 154(b) by 168 days.

(21) Appl. No.: 13/937,170

(22) Filed: Jul. 8, 2013

Related U.S. Application Data

(60) Provisional application No. 61/725,876, filed on Nov. 13, 2012.

(51) Int. Cl.
*A63B 21/00* (2006.01)
*A63B 71/00* (2006.01)

(52) U.S. Cl.
CPC ..... *A63B 71/00* (2013.01)

(58) Field of Classification Search
USPC ..... 482/35, 33, 112, 83, 90, 87
See application file for complete search history.

(56) References Cited

U.S. PATENT DOCUMENTS

| | | | |
|---|---|---|---|
| 3,130,816 | A | 4/1964 | Wright |
| 3,765,673 | A | 10/1973 | Daw |
| 4,598,905 | A | 7/1986 | Vrana |
| 4,836,530 | A | 6/1989 | Stanley, Jr. |
| 5,613,922 | A | 3/1997 | Hsiang |
| 5,921,899 | A | 7/1999 | Rose |
| 6,679,811 | B2 | 1/2004 | Chen |
| 8,246,521 | B2 | 8/2012 | Alexander et al. |
| 2003/0064861 | A1 | 4/2003 | Chen |

*Primary Examiner* — Jerome W Donnelly
(74) *Attorney, Agent, or Firm* — RG Patent Consulting, LLC; Rachel Gilboy

(57) ABSTRACT

A pneumatic tube jumping structure system to increase the safety and enjoyment of jumping and other physical activities. The pneumatic tube jumping structure employs a metal frame to support a pneumatic tube upon which a single user or multiple users may jump, bounce, or otherwise play. The frame provides safety handrails that serve dual purposes: ensuring the safety of a user; and aiding a user in jumping and otherwise making use of the pneumatic tube jumping structure system. The frame also allows for the connection of an activity attachment, such as a rope swing, for the enjoyment of a user, making the structure a multi-purpose amusement and exercise device.

20 Claims, 5 Drawing Sheets

JUNGLE JUMPAROO SYSTEMS

CROSS-REFERENCE TO RELATED APPLICATION

The present application is related to and claims priority from prior provisional application Ser. No. 61/725,876, filed Nov. 13, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

FIELD OF THE INVENTION

The present invention relates generally to the field of jumping structures and more specifically relates to pneumatic tube jumping structures incorporating safety support frames and interchangeable activity accessories.

DESCRIPTION OF THE RELATED ART

Many individuals in modern society participate in physical activities for exercise and amusement purposes. Such physical activities as running and jumping improve health, reduce stress, and bring enjoyment to an individual's life. Children are especially encouraged to participate in physical activities to increase their desire to include exercise in daily activities as they mature through adolescence and into adulthood. To obtain this much-needed exercise, children are often encouraged to play outdoors; however, weather fluctuations throughout the year keep many children indoors during playtime. Indoor physical activities are often limited—parents generally disapprove of balls being thrown, races being run, and bikes being ridden indoors. The safety of children as well as that of breakable objects prevents many such activities being conducted indoors. Whether or not the weather and daylight conditions allow for outdoor playtime, children are often confined to a limited play space. Indoor play spaces, outdoor yards, and shared green spaces many times serve multiple purposes—playground, storage area, food preparation/serving area, and such. While children enjoy engaging in multiple activities throughout a playtime, many multi-activity play structures are too large to fit within confined play areas.

Various attempts have been made to solve the above-mentioned problems such as those found in U.S. Pat. Nos. 3,765,673; 4,836,530; 5,921,899; 4,598,905; 5,613,922; 8,246,521; 3,130,816; 2003/0064861; and 6,679,811. This prior art is representative of jumping structures. None of the above inventions and patents, taken either singly or in combination, is seen to describe the invention as claimed.

Ideally, a pneumatic tube jumping structure incorporating a support frame and interchangeable activity accessories should be durable, stable, user friendly, and, yet, would operate reliably and be manufactured at a modest expense. Thus, a need exists for a reliable pneumatic tube jumping structure system incorporating a safety support frame and interchangeable activity accessories to increase the safety and enjoyment of jumping and other physical activities and to avoid the above-mentioned problems.

BRIEF SUMMARY OF THE INVENTION

In view of the foregoing disadvantages inherent in the known jumping structures art, the present invention provides a novel Jungle Jumparoo System. The general purpose of the present invention, which will be described subsequently in greater detail, is to provide a pneumatic tube jumping structure system incorporating a safety support frame and interchangeable activity accessories to increase the safety and enjoyment of jumping and other physical activities.

A pneumatic tube jumping structure system is disclosed herein preferably comprising: a frame, a pneumatic tube, and at least one activity attachment. The frame preferably has a plurality of upright posts; a connection ring; and a support base that includes a plurality of both straight lateral members and corner members. Each of the upright posts is releasably attached at one end to the support base; extends vertically from the support base; is releasably attached at its other, angled, end to the outer surface of the connection ring; and is equidistantly spaced about the circumference of the connection ring from each of the other upright posts.

The lateral members of the support base are connected end-to-end to both the other lateral members and to the corner members of support base in such a way as to form a horizontal support base with a square footprint in order to provide stability and to support the pneumatic tube jumping structure upon a ground surface. Each lateral member has at least one protruding bar that extends horizontally perpendicular to the lateral member toward the center of the support base. Each protruding bar is angled upward perpendicular to the lateral member (toward the sky) at its midpoint, resulting in an "L"-shaped protruding bar. As the upright posts, lateral members, and protruding bars are preferably cylindrical tubes, each upright post may be friction-fit over the vertical shaft of a protruding bar, thereby releasably connecting each upright post to the support base. Connected as such, the combination of upright posts, support base, and connection ring constitutes the frame of the pneumatic tube jumping structure system.

The connection ring is preferably an octagonal continuous metal ring that maximizes the structural rigidity of the frame. The upright posts may be releasably attached to the connection ring by at least one fastener, a bolt-and-nut combination in the present embodiment. Also releasably attached to and suspended from the connection ring may be an activity attachment. This activity attachment provides that the pneumatic tube jumping structure system may be a multi-purpose jumping and activity structure that allows a user to enjoy a plurality of games and amusement activities during use. The activity attachment of the present embodiment is preferably a rope swing with two ends, each of which may be attached to connection ring to anchor the swing to the frame of the pneumatic tube jumping structure system. A variety of activity attachments may be used in place of the rope swing for the amusement of a user.

The pneumatic tube of the present embodiment is preferably an elastomeric circular ring that has an inner diameter and an outer diameter—the inner diameter defining a center void. The pneumatic tube surrounds a portion of the frame while resting thereon, providing a bouncing surface for at least one user. Each upright post extends vertically from the support base, through the center void of the pneumatic tube, and acts as a handrail for at least one user during use. Additionally, the upright posts of the frame prevent horizontal movement and flipping of the pneumatic tube while in use.

In the present embodiment, the modular frame and the pneumatic tube are collapsible, thereby allowing the pneumatic tube jumping structure system to be dismantled for storage and transport. The pneumatic tube jumping structure system may be employed both indoors and outdoors for the amusement of multiple users at one time. Many sizes of the pneumatic tube jumping structure system may be used, based on the needs and preferences of a user.

A method of using a pneumatic tube jumping structure system is also described herein preferably comprising the steps of: attaching each angled end of a plurality of upright posts to a connection ring; attaching each free end of the upright posts to a support base, thereby creating a frame; attaching an activity attachment to the connection ring; inflating a pneumatic tube; lowering the pneumatic tube over the frame, with the upright posts protruding vertically through a center void of the pneumatic tube; gripping at least one upright post and bodily mounting the pneumatic tube; completing at least one jump; gripping the activity attachment; and completing at least one activity. The method further comprises the steps of removing the activity attachment from the connection ring and attaching an alternate activity attachment to the connection ring.

The present invention holds significant improvements and serves as a pneumatic tube jumping structure system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Jungle Jumparoo Systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a pneumatic tube jumping structure device and more particularly to a Jungle Jumparoo System as used to increase the safety and enjoyment of jumping and other physical activities.

Figure 1:
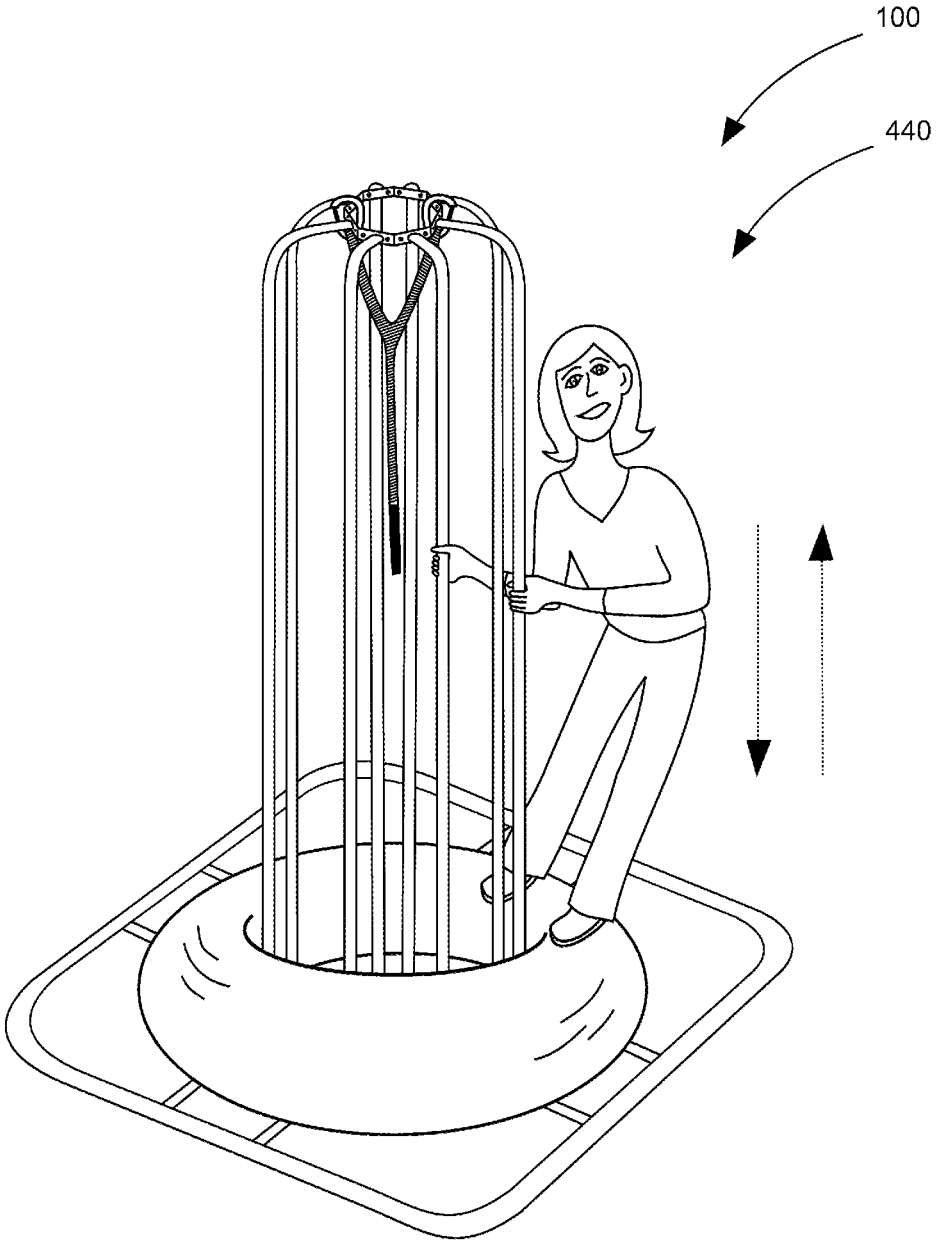
FIG. 1 shows a perspective view illustrating a pneumatic tube jumping structure system in an in-use condition according to an embodiment of the present invention.

Referring now to the drawings by numerals of reference, there is shown in FIG. 1 a perspective view illustrating pneumatic tube jumping structure system 100 in an in-use condition according to an embodiment of the present invention.

Pneumatic tube jumping structure system 100 preferably comprises: pneumatic tube 200; at least one activity attachment 400; and frame 205 having connection ring 325, at least one, but preferably a plurality of, upright post(s) 310, and support base 315 that includes at least one, but preferably a plurality of, straight lateral member(s) 320 and at least one, but preferably a plurality of, corner member(s) 317. Ideally, upright post(s) 310, support base 315, and connection ring 325, in combination, constitute frame 205. In preferred embodiments, pneumatic tube 200 may rest upon support base 315 and may substantially surround a portion of frame 205. Arranged in this way, pneumatic tube 200 may preferably act in a capacity of a bouncing surface for at least one user.

Each upright post 310 preferably extends vertically form support base 315, and may thereby act in a capacity of a handrail for at least one user. In the present embodiment, a plurality of upright post(s) 310 may be used and may act in a capacity of handrails for multiple users simultaneously using pneumatic tube jumping structure system 100. Additionally, at least one activity attachment 400 may preferably be releasably attached to and suspended from connection ring 325 so as to provide activity alternatives to users of pneumatic tube jumping structure system 100. Versatile in design, pneumatic tube jumping structure system 100 may be used indoors or outdoors, according to the desires and requirements of a user. Optionally, a texturized membrane, base tray, or the like may be employed to act in a capacity of a barrier between an underside surface of support base 315 and a ground surface upon which pneumatic tube jumping structure system 100 may rest. Such a barrier may be used to prevent horizontal movement of pneumatic tube jumping structure system 100 along a ground surface. Upon reading this specification, it should be appreciated that, under appropriate circumstances, considering such issues as user preferences, design preference, structural requirements, marketing preferences, cost, available materials, technological advances, etc., other non-skid barrier arrangements such as, for example, mats, adhesive strips, suction cups, etc., may be sufficient.

Figure 2:
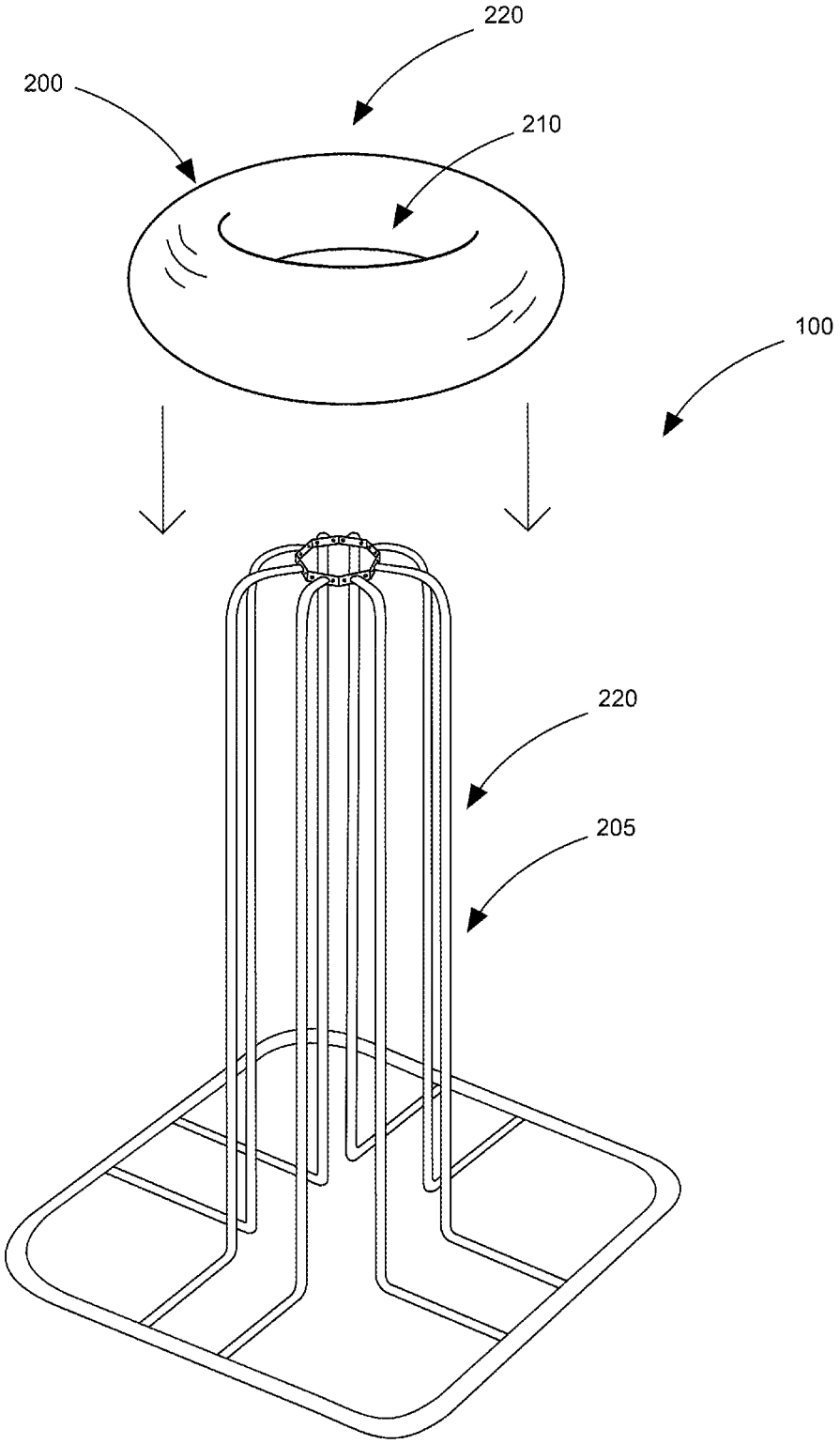
FIG. 2 is a perspective view illustrating the pneumatic tube jumping structure system as a frame and a pneumatic tube according to an embodiment of the present invention of FIG. 1.

Referring now to FIG. 2, a perspective view illustrating pneumatic tube jumping structure system 100 as frame 205 and a pneumatic tube 200 shown according to an embodiment of the present invention of FIG. 1.

Support base 315 preferably comprises a plurality of lateral member(s) 320 and a plurality of corner member(s) 317. Each lateral member 320 may be releasably connected end-to-end to both lateral member(s) 320 and corner member(s) 317, preferably in a friction-fit manner. In other embodiments, lateral member(s) 320 and corner member(s) 317 may be releasably connected one to another using alternate latching means such as hooks, threaded fasteners, pins, or the like. In the present embodiment, lateral member(s) 320 and corner member(s) 317 may preferably be friction-fit connected in a manner so as to form a continuous perimeter for a substantially horizontal support base 315. In this way, support base 315 may support pneumatic tube jumping structure system 100 upon a ground surface.

The configuration of support base 315 resulting from connecting lateral member(s) 320 and corner member(s) 317 may preferably yield a substantially square footprint, thereby maximizing stability of pneumatic tube jumping structure system 100 during use.

In other embodiments, support base 315 may comprise only lateral member(s) 320 such that lateral member(s) 320 may form individual horizontally protruding feet as opposed to a continuous perimeter for support base 315. In yet other embodiments, lateral member(s) 320 may be substantially curved such that by connecting each lateral member 320 end-to-end, a support base 315 with a substantially circular footprint may be formed. Further, lateral member(s) 320, independently or in conjunction with corner member(s) 317, may be arranged so as to form support base 315 of various shapes such as rectangles, octagons, triangles, and the like. Those with ordinary skill in the art will now appreciate that upon reading this specification and by their understanding the art of constructing support frames as described herein, methods of creating horizontal support frames will be understood by those knowledgeable in such art.

Within this particular embodiment shown, each upright post 310 may preferably be releasably attached at a proximate end to support base 315 and extend essentially vertically therefrom. Further, each upright post 310 may comprise an angled distal end that may be releasably attached to an outer surface of connection ring 325. Each upright post 310 may preferably be spaced equidistant one from another about the circumference of connection ring 325. In the present embodiment, pneumatic tube jumping structure system 100 preferably comprises a plurality of upright post(s) 310. Other embodiments, however, may comprise as few as one upright post 310 attached to and protruding from support base 315. Those with ordinary skill in the art will now appreciate that upon reading this specification and by their understanding the art of constructing support frames as described herein, methods of creating vertical support frames will be understood by those knowledgeable in such art.

Preferably comprising an elastomer, pneumatic tube 200 of the present embodiment may further comprise a substantially circular ring having both an inner diameter and an outer diameter in addition to a circular cross-section. This inner diameter preferably defines center void 210, through which upright post(s) 310 protrude as shown in FIG. 1. While the present embodiment shows the cross-section of pneumatic tube 200 to be substantially circular, other cross-sections such as squares, triangles, octagons, or the like may be used. Upon reading this specification, it should be appreciated that, under appropriate circumstances, considering such issues as user preferences, design preference, structural requirements, marketing preferences, cost, available materials, technological advances, etc., other resilient material arrangements such as, for example, canvas, leather, etc., may be sufficient.

In preferred embodiments, pneumatic tube 200 may comprise at least one air valve for inflating and/or deflating pneumatic tube. Optionally, pneumatic tube 200 may comprise a pressure gage so as to allow a user to determine optimum inflation for comfort and safety purposes. Further, pneumatic tube 200 may comprise at least one handle in order to facilitate transport of pneumatic tube 200. Those with ordinary skill in the art will now appreciate that upon reading this specification and by their understanding the art of constructing pneumatic tubes as described herein, methods of designing and constructing pneumatic tubes will be understood by those knowledgeable in such art.

Pneumatic tube jumping structure system 100 preferably comprises frame 205 and pneumatic tube 200 operating in combination to provide entertainment, exercise, and the like to at least one user, as at least one user bounces, jumps, or otherwise plays atop pneumatic tube 200. Alternately, pneumatic tube 200 may act in a capacity of independent play structure 220. Similarly, frame 205, individually or in conjunction with at least one activity attachment 400, may act in a capacity of independent play structure 220. The uses of frame 205, pneumatic tube 200, and activity attachment 400 and the combination thereof may be determined by the desires and requirements of a user.

Figure 3:
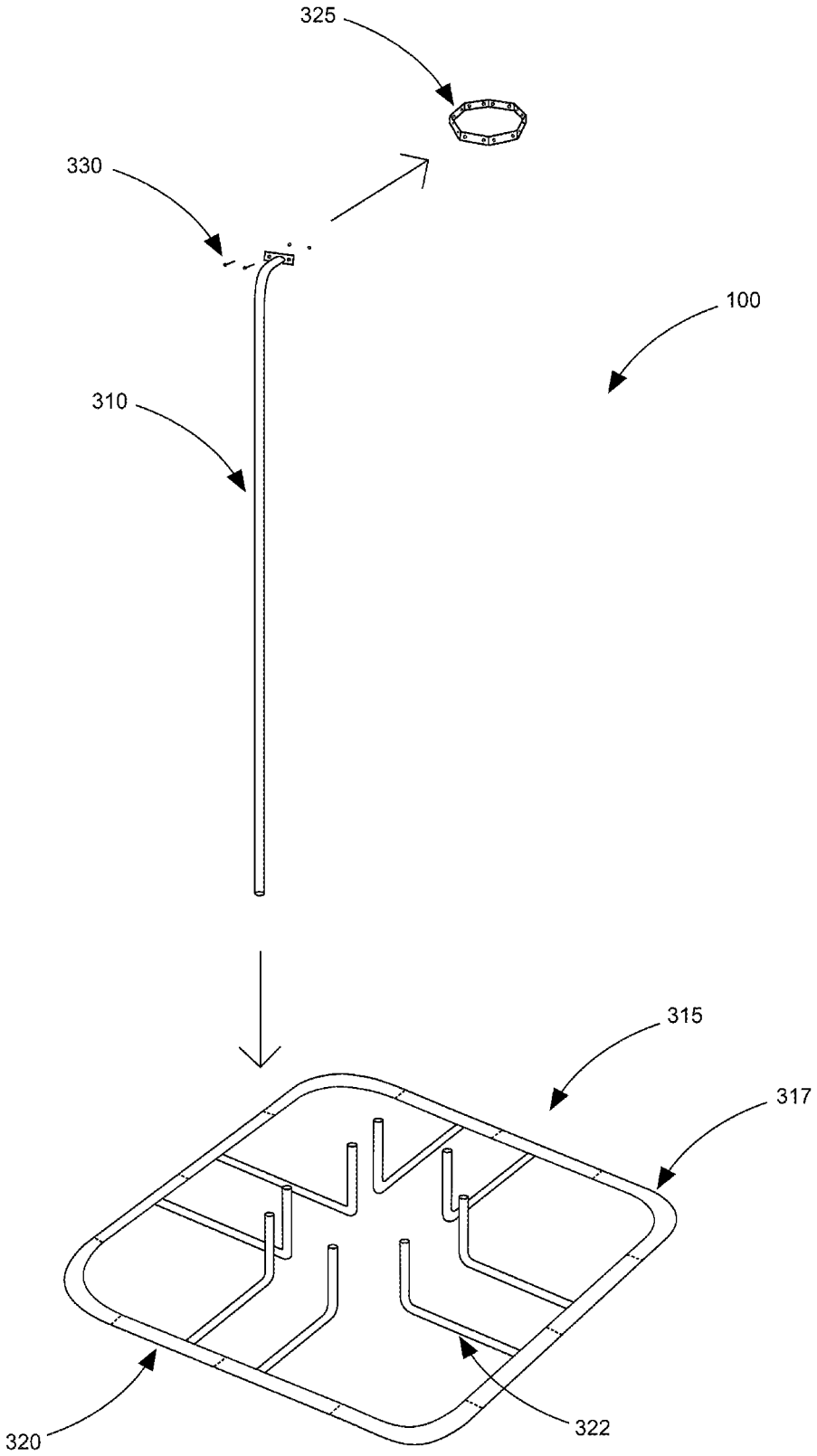
FIG. 3 is an exploded view illustrating the pneumatic tube jumping structure system with a connection ring, an upright post, fasteners, and a support base according to an embodiment of the present invention of FIGS. 1 and 2.

FIG. 3 shows an exploded view illustrating pneumatic tube jumping structure system 100 with connection ring 325, upright post 310, fastener(s) 330, and support base 315 according to an embodiment of the present invention of FIGS. 1 and 2.

Ideally, connection ring 325 may provide frame 205 is modular. Connection ring 325 of the present embodiment may preferably comprise a substantially octagonal continuous metal ring in order to maximize the structural rigidity of frame 205. Each upright post 310 may preferably be releasably attached to connection ring 325 by at least one fastener 330, fastener(s) 330 of the present embodiment preferably comprising nut-and-bolt combinations. Upright post(s) 310 may vary in number and arrangement about circumference of connection ring 325; the present embodiment outlines eight upright post(s) 310—one upright post 310 connected to each facet of the outer surface of octagonal connection ring 325. In other embodiments, pneumatic tube jumping structure system 100 may comprise connection ring 325 of alternate shapes such as circles, triangles, squares, or the like. Further, connection ring 325 may optionally comprise a solid metal plate, disk, or the like. Those with ordinary skill in the art will now appreciate that upon reading this specification and by their understanding the art of connecting structural members as described herein, methods of connecting and stabilizing support frame members will be understood by those knowledgeable in such art.

The present figure illustrates support base 315 comprising lateral member(s) 320 in combination with corner member(s) 317, each lateral member 320 having at least one protruding bar 322. In the present embodiment, each protruding bar 322 preferably extends horizontally perpendicular to lateral member 320 toward the center of support base 315. Further, protruding bar 322 preferably extends vertically perpendicular to lateral member 320, preferably at the midpoint of protruding bar 322. Each upright post 310 of the present embodiment may preferably be friction-fit over at least one corresponding protruding bar 322. In this manner, each upright post 310 may be releasably attached to support base 315. Upon reading this specification, it should be appreciated that, under appropriate circumstances, considering such issues as user preferences, design preference, structural requirements, marketing preferences, cost, available materials, technological advances, etc., other connection and fastening arrangements such as, for example, hooks, threaded fasteners, pins, etc., may be sufficient. Those with ordinary skill in the art will now appreciate that upon reading this specification and by their understanding the art of forming and attaching structural elements as described herein, methods of forming and connecting structural elements one to another will be understood by those knowledgeable in such art.

Preferably, upright post(s) 310, lateral member(s) 320, corner member(s) 317, and protruding bar(s) 322 comprise metal circular-cylindrical tubes. These tubes may be hollow, solid, or a combination thereof. In other embodiments, each of the aforementioned members may comprise cylindrical tubes of alternately-shaped cross-sections, e.g. square, triangular, octagonal, and the like. Upon reading this specification, it should be appreciated that, under appropriate circumstances, considering such issues as user preferences, design preference, structural requirements, marketing preferences, cost, available materials, technological advances, etc., other structural material arrangements such as, for example, plastic, wood, composites, etc., may be sufficient. Those with ordinary skill in the art will now appreciate that upon reading this specification and by their understanding the art of forming structural elements as described herein, methods of forming and connecting structural elements will be understood by those knowledgeable in such art.

Figure 4:
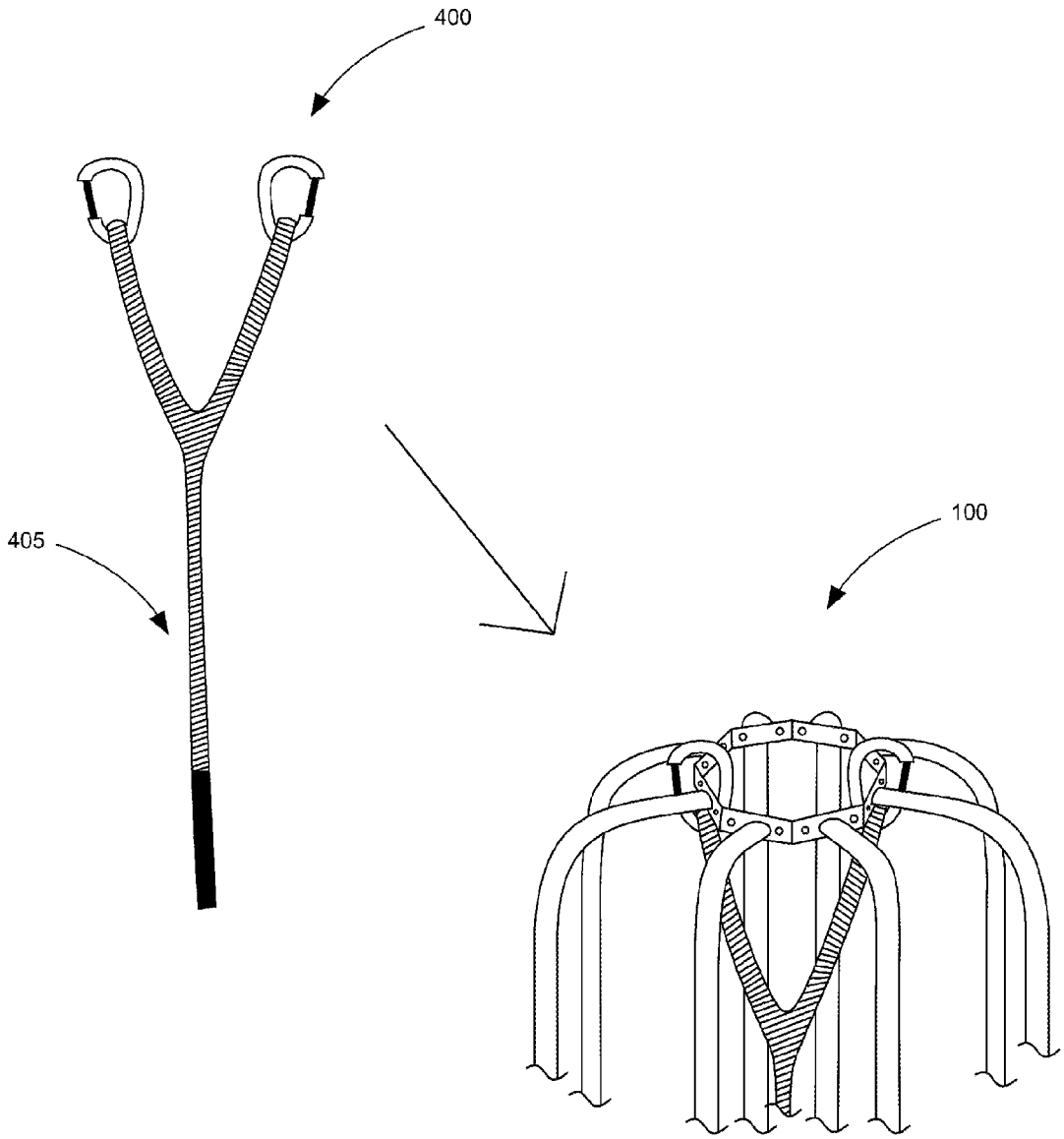
FIG. 4 is a perspective view illustrating the pneumatic tube jumping structure system according to an embodiment of the present invention of FIGS. 1-3.

FIG. 4 shows a perspective view illustrating pneumatic tube jumping structure system 100 shown according to an embodiment of the present invention of FIGS. 1-3.

Activity attachment 400 of the present embodiment preferably comprises swing 405 comprising rope having: one distal end, preferably terminating in a handle; and at least one proximate end, preferably releasably attachable to frame 205. As shown in FIG. 4, swing 405 in the present embodiment preferably comprises two proximate ends converging at a midpoint of swing 405. These two proximate ends of swing 405 may preferably be releasably connected to connection ring 325 in such a manner as to allow swing 405 to essentially be suspended therefrom. In this manner, connection ring 325 preferably acts in a capacity of an anchor, preventing unintentional movement of swing 405, e.g. slipping out of position, sliding along upright post(s) 310, or the like. The present figure illustrates attachment means for each proximate end of swing 405 to connection ring 325 as metal D-shaped spring-loaded gate clips. Upon reading this specification, it should be appreciated that, under appropriate circumstances, considering such issues as user preferences, design preference, structural requirements, marketing preferences, cost, available materials, technological advances, etc., other attachment and anchoring arrangements such as, for example, hooks, clamps, chains, etc., may be sufficient. Those with ordinary skill in the art will now appreciate that upon reading this specification and by their understanding the art of attaching and anchoring as described herein, methods of securing attachments to structural members will be understood by those knowledgeable in such art.

While the present embodiment outlines activity attachment 400 as swing 405, pneumatic tube jumping structure system 100 in other embodiments may comprise any variety of activity attachment(s) 400, such as an elastic band for bouncing, a chain for climbing, and the like. As such, releasably-attached activity attachment 400 effectively ensures pneumatic tube jumping structure system 100 acts in a capacity of a multi-purpose jumping and activity structure by providing a user with access to a plurality of amusement activities.

Ideally, pneumatic tube 200 and modular frame 205 are collapsible in such a manner as to facilitate the dismantling of pneumatic tube jumping structure system 100 by a user for storage and transport. With regard to the requirements and desires of a user, pneumatic tube and jumping structure system may be manufactured in myriad sizes with customizable ornamentation, features, and attachments.

Pneumatic tube jumping structure system 100 may be sold as kit 440 comprising the following parts: at least one pneumatic tube 200; at least one upright post 310; at least one support base 315; at least one connection ring 325; at least one activity attachment 400; and at least one set of user instructions. Pneumatic tube jumping structure system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
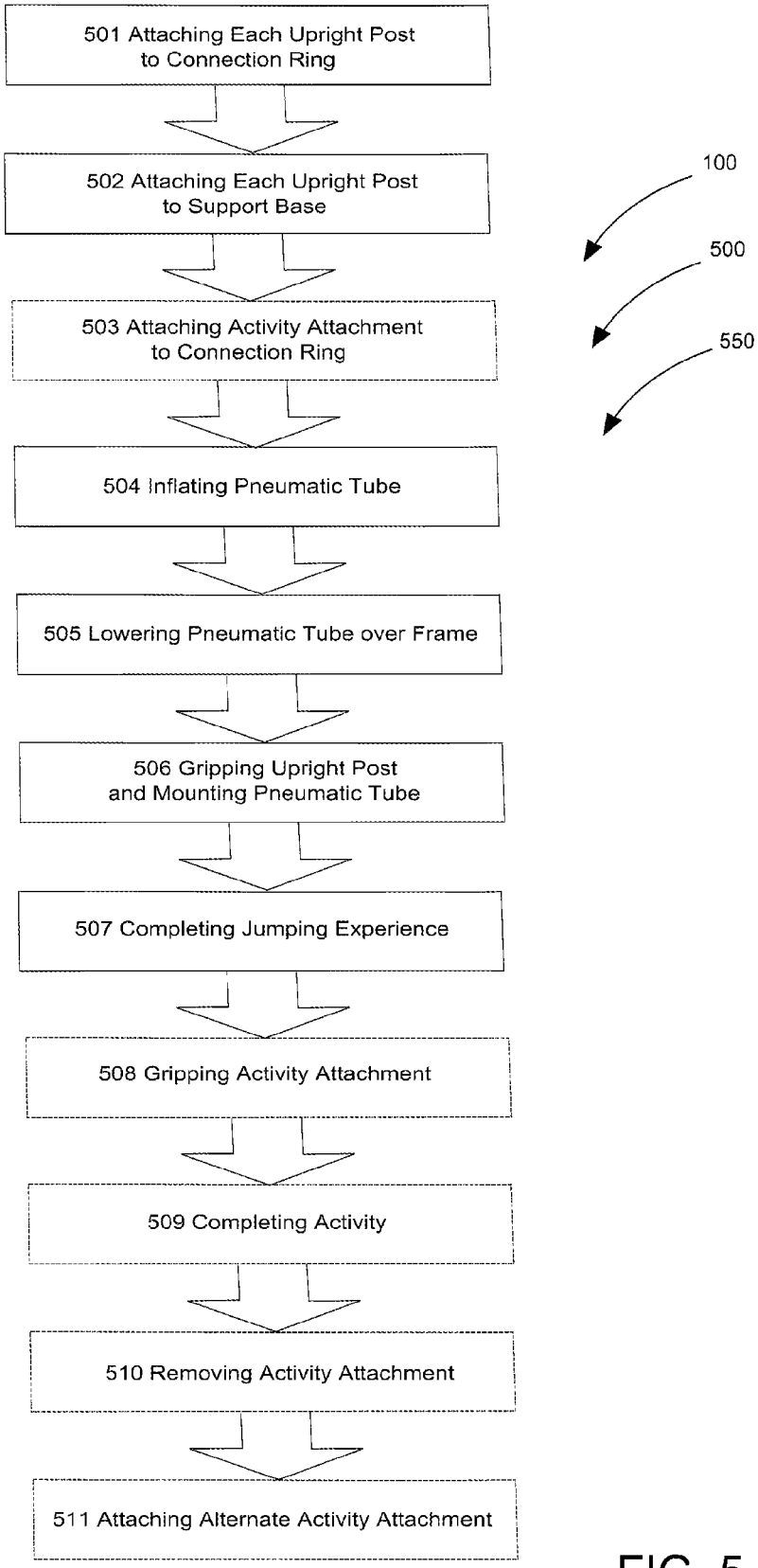
FIG. 5 is a flowchart illustrating a method of use for the pneumatic jumping structure system according to an embodiment of the present invention of FIGS. 1-4.

FIG. 5 is flowchart 550 illustrating method of use 500 for pneumatic jumping structure system 100 according to an embodiment of the present invention of FIGS. 1-4.

A method of using (at least hereby enabling method of use 500) a pneumatic jumping structure system 100 preferably comprising the steps of: step one 501 attaching each angled end of a plurality of upright post(s) 310 to connection ring 325; step two 502 attaching each free end of each upright post 310 to support base 315, thereby creating frame 205; step three 503 attaching activity attachment 400 to connection ring 325; step four 504 inflating pneumatic tube 200; step five 505 lowering pneumatic tube 200 over frame 205, with upright post(s) 310 protruding vertically through center void 210 of pneumatic tube 200; step six 506 gripping at least one upright post 310 and bodily mounting pneumatic tube 200; step seven 507 completing at least one jumping experience atop pneumatic tube 200; step eight 508 gripping activity attachment 400; and step nine 509 completing at least one activity.

The method of use 500 preferably further comprises the steps of: step ten 510 removing activity attachment 400 from connection ring 325; and step eleven 511 attaching an alternate activity attachment 400 to connection ring 325 for the purposes of completing at least one activity.

It should be noted that step three 503 as well as step eight 508—step eleven 511 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A pneumatic tube jumping structure system comprising:
a frame having;
a plurality of upright posts;
a support base including a plurality of straight lateral members and a plurality of corner members;
a connection ring;
a pneumatic tube; and
at least one activity attachment;
wherein each said upright post is releasably attached at a proximate end to said support base, extends vertically from said support base, is releasably attached at a distal angled end to an outer surface of said connection ring, and is equidistantly spaced about the circumference of said connection ring from other said upright posts;
wherein said lateral members are releasably connected end-to-end to both other said lateral members and to said corner members, thereby forming a continuous perimeter for a substantially horizontal said support base to support said pneumatic tube jumping structure system upon a ground surface;
wherein said upright posts, said support base, and said connection ring, in combination, constitute said frame;
wherein at least one said activity attachment is releasably attached to said connection ring and is suspended therefrom;
wherein said pneumatic tube substantially surrounds a portion of said frame while resting thereon and thereby acts in a capacity of a bouncing surface for at least one user; and
wherein each said upright post extends substantially vertically from said support base, and thereby acts in a capacity of a handrail for at least one user during a jumping experience.

2. The pneumatic tube jumping structure system of claim 1 wherein each said lateral member comprises at least one protruding bar extending horizontally perpendicular to said lateral member toward a center of said support base and angling vertically perpendicular to said lateral member at a midpoint of said protruding bar.

3. The pneumatic tube jumping structure system of claim 1 wherein said upright posts, said lateral members, and said protruding bars comprise cylindrical tubes.

4. The pneumatic tube jumping structure system of claim 1 wherein each said upright post is friction-fit over at least one said protruding bar of at least one said lateral member, thereby releasably connecting each said upright post to said support base.

5. The pneumatic tube jumping structure system of claim 1 wherein said lateral members are arranged in a configuration resulting in said support base having a substantially square footprint to maximize stability during use.

6. The pneumatic tube jumping structure system of claim 1 wherein said connection ring comprises a substantially octagonal continuous metal ring, thereby maximizing the structural rigidity of said frame.

7. The pneumatic tube jumping structure system of claim 1 wherein each said upright post is releasably attached to said connection ring via at least one fastener.

8. The pneumatic tube jumping structure system of claim 7 wherein said fastener comprises a bolt-and-nut combination.

9. The pneumatic tube jumping structure system of claim 1 wherein said connection ring provides said frame is modular, said upright posts varying in number and arrangement about said connection ring.

10. The pneumatic tube jumping structure system of claim 1 wherein said upright posts, said lateral members, said corner members, said protruding bars, and said connection ring comprise metal.

11. The pneumatic tube jumping structure system of claim 1 wherein said pneumatic tube is a substantially circular ring having an inner diameter and an outer diameter, said inner diameter defining said center void.

12. The pneumatic tube jumping structure system of claim 11 wherein said pneumatic tube comprises an elastomer.

13. The pneumatic tube jumping structure system of claim 1 wherein said activity attachment comprises a swing.

14. The pneumatic tube jumping structure system of claim 1 wherein said swing comprises rope, said rope having two ends releasably attached separate and apart each one from another to said connection ring, said connection ring thereby acting in a capacity of an anchor for said swing.

15. The pneumatic tube jumping structure system of claim 1 wherein modular said frame and said pneumatic tube are collapsible so as to allow pneumatic tube jumping structure to be dismantled for storage and transport.

16. The pneumatic tube jumping structure system of claim 1 wherein said frame, individually and alternately in conjunction with at least one said activity attachment, acts in a capacity of an independent play structure.

17. The pneumatic tube jumping structure system of claim 1 wherein said pneumatic tube acts in a capacity of an independent play structure.

18. A pneumatic tube jumping structure system comprising:
a frame having:
a plurality of upright posts;
a support base including a plurality of straight lateral members and a plurality of corner members;
a connection ring;
a pneumatic tube; and
at least one activity attachment;
wherein each said upright post is releasably attached at a proximate end to said support base, extends vertically from said support base, is releasably attached at a distal angled end to an outer surface of said connection ring, and is equidistantly spaced about the circumference of said connection ring from other said upright posts;
wherein said lateral members are releasably connected end-to-end to both other said lateral members and to said corner members, thereby forming a continuous perimeter for a substantially horizontal said support base to support said pneumatic tube jumping structure system upon a ground surface;
wherein said lateral members are arranged in a configuration resulting in said support base having a substantially square footprint to maximize stability during use;
wherein each said lateral member comprises at least one protruding bar extending horizontally perpendicular to said lateral member toward a center of
said support base and angling vertically perpendicular to said lateral member at a midpoint of said protruding bar;
wherein said upright posts, said lateral members, and said protruding bars comprise cylindrical tubes;

wherein each said upright post is friction-fit over at least one said protruding bar of at least one said lateral member, thereby releasably connecting each said upright post to said support base;

wherein said upright posts, said support base, and said connection ring, in combination, constitute said frame;

wherein said connection ring comprises a single continuous metal ring, providing increased stability at apex of said frame;

wherein said connection ring is substantially octagonal and provides that said frame is modular;

wherein said upright posts are releasably attached to said connection ring via at least one fastener, said fastener comprising a bolt-and-nut combination;

wherein at least one said activity attachment is releasably attached to said connection ring and is suspended therefrom, ensuring said pneumatic tube jumping structure system acts in a capacity of a multi-purpose jumping and activity structure, providing a user with access to a plurality of games and amusement activities during use;

wherein said activity attachment comprising a swing, said swing comprising rope;

wherein said swing is releasably attached at two ends to said connection ring, thereby being anchored thereto and suspended therefrom;

wherein said pneumatic tube comprises an elastomer;

wherein said pneumatic tube is a substantially circular ring having an inner diameter and an outer diameter, said inner diameter defining said center void;

wherein said pneumatic tube substantially surrounds a portion of said frame while resting thereon and thereby acts in a capacity of a bouncing surface for at least one user;

wherein each said upright post extends substantially vertically from said support base, and thereby acts in a capacity of a handrail for at least one user during a jumping experience; and wherein modular said frame and said pneumatic tube are collapsible so as to allow pneumatic tube jumping structure to be dismantled for storage and transport.

19. A method of assembling and using a pneumatic tube jumping structure system comprising the steps of:

attaching each angled end of a plurality of upright posts to a connection ring;

attaching each free end of said upright posts to a support base, thereby creating a frame;

attaching an activity attachment to said connection ring;

inflating a pneumatic tube;

lowering said pneumatic tube over said frame, with upright posts protruding vertically through a center void of said pneumatic tube;

gripping at least one said upright post and bodily mounting said pneumatic tube;

completing at least one jumping experience;

gripping said activity attachment; and completing at least one activity.

20. The method of claim 19 further comprising the steps of removing said activity attachment from said connection ring and attaching an alternate activity attachment to said connection ring.

* * * * *